US005667730A

United States Patent [19]

Barfield

[11] Patent Number: 5,667,730

[45] Date of Patent: Sep. 16, 1997

[54] FLOAT BOWL ATTACHMENT FOR CARBURETOR

[76] Inventor: Melvin Russell Barfield, 7412 SW 29th St., Davie, Fla. 33314

[21] Appl. No.: 762,413

[22] Filed: Dec. 9, 1996

Related U.S. Application Data

[63] Continuation-in-part of Ser. No. 527,537, Sep. 13, 1995, abandoned.

[51] Int. Cl.[6] ..... F02M 13/06

[52] U.S. Cl. ..... 261/18.3; 261/23.2; 261/34.1; 261/34.2; 261/67; 261/70; 261/DIG. 50

[58] Field of Search ..... 261/23.2, 18.3, 261/34.1, 34.2, 67, 70, DIG. 50

[56] References Cited

U.S. PATENT DOCUMENTS

| | | | |
|---|---|---|---|
| 1,545,284 | 7/1925 | Schwab | 261/70 |
| 1,933,360 | 10/1933 | Barbarou | 261/70 |
| 2,556,463 | 6/1951 | Bicknell | 261/70 |
| 2,892,622 | 6/1959 | Goodyear | 261/34.1 |
| 3,372,912 | 3/1968 | Benmore | 261/70 |
| 3,807,377 | 4/1974 | Hirschler, Jr. et al. | 123/127 |
| 4,085,720 | 4/1978 | Etoh | 123/127 |
| 4,235,827 | 11/1980 | Gopel | 261/70 |
| 4,415,507 | 11/1983 | Voliva | 261/18 B |
| 4,441,467 | 4/1984 | Powell | 123/179 G |
| 4,737,319 | 4/1988 | Saxby | 261/70 |
| 5,181,488 | 1/1993 | Sakurai | 123/179.11 |
| 5,309,875 | 5/1994 | Gault | 123/179.16 |

FOREIGN PATENT DOCUMENTS

| | | | |
|---|---|---|---|
| 665460 | 6/1963 | Canada | 123/139 |
| 159948 | 10/1982 | Japan | 261/70 |

*Primary Examiner*—Tim R. Miles
*Attorney, Agent, or Firm*—Howrey & Simon

[57] ABSTRACT

An attachment for a fuel carburetor possesses a fuel inlet, a needle-and-seat valve disposed in the inlet, and a float attached to the needle-and-seat valve. In one embodiment, the attachment is placed between and is in fluid communication with both the float bowl and the metering block of a typical carburetor. Fuel is pumped into the float bowl and the attachment in parallel from the fuel pump. The float in the attachment rises and falls according to the level of fuel in the interior of the attachment and float bowl, and thus regulates the position of the needle-and-seat valve, which in turn regulates how much fuel is pumped into the attachment and float bowl. The attachment is also provided with a device for injecting a spurt of fuel directly into the metering block to avoid lean fuel conditions when the throttle is initially opened. In an alternative arrangement, the float bowl and attachment are made as one integral unit. In another embodiment, two attachments and an end cap are mounted on the metering block and the float bowl is not used.

27 Claims, 6 Drawing Sheets

FLOAT BOWL ATTACHMENT FOR CARBURETOR

RELATED PATENT APPLICATION

This patent application is a continuation-in-part of commonly owned, application Ser. No. 08/527,537, filed on Sep. 13, 1995, now abandoned, entitled "Float Bowl Attachment for Carburetor," the disclosure of which is incorporated herein by reference.

BACKGROUND OF THE INVENTION

1. Field of the Invention

The invention relates to fuel carburetors. More particularly, the invention relates to the fuel bowl that supplies fuel to the main body of the carburetor.

2. Description of Related Art

Float bowls are conventionally used in carburetors. In the typical fuel system of an automobile, a fuel pump pushes fuel into the float bowl via an inlet. Disposed in the inlet is a needle-and-seat valve which is attached to a float. The float rises and falls with the level of the fuel in the float bowl, causing the needle-and-seat valve to either open or close. Vacuum from the venturi of the carburetor pulls fuel out of the float bowl through the metering block to which the float bowl is attached. When the fuel level in the float bowl falls, the float falls and opens the needle-and-seat valve, and fuel is allowed to enter the float bowl. When the fuel level rises, the float rises and closes the needle-and-seat valve, preventing excess or unnecessary fuel from entering the float bowl.

Race cars conventionally use various different types of fuel, such as gasoline, kerosene, alcohol, and the like. The use of different fuels may require the use of differently configured carburetors. In one example, a dual-fuel carburetor may use both gasoline and alcohol, with one fuel being supplied to one float bowl of the carburetor and the other fuel being supplied to the other float bowl on the opposite side of the carburetor. Such a carburetor is described in U.S. Pat. No. 4,415,507 to Voliva. The Voliva patent describes a modified Holley 4150-60 carburetor, in which gasoline is pumped into the inlet of a primary float bowl and alcohol is pumped into the inlet of a secondary float bowl. Other dual-fuel systems are described in U.S. Pat. Nos. 4,085,720 to Etoh and 3,807,377 to Hirschler, Jr. et al. In both of these systems, a switching device is provided to switch between two float bowls, each supplied with different fuel. Throttle conditions (e.g., pressure) determine when the switching device will select one fuel over the other.

In some cases, it is desirable (e.g., from a cost and/or performance standpoint) to modify an existing fuel system which is designed to run on one type of fuel so that it may run on a different type of fuel. For example, many race cars' fuel systems are initially designed to consume gasoline, and are subsequently provided alcohol. Owing to several factors, such as the augmented power requirements of racing vehicles, the automobile requires approximately twice as much alcohol as gasoline by volume per unit time.

A problem arises in how to deliver the lower-volatility alcohol to the venturi of the carburetor. Specifically, roughly twice as much fuel must be delivered through the float bowl in the same amount of time. A known previous method of rectifying this problem is to boost the fuel pressure in the fuel line by using a larger, more powerful fuel pump upstream of the float bowl of the carburetor. By using a fuel pump twice as powerful as the pump originally provided with the automobile, the requisite amount of alcohol can be delivered to the float bowl.

This method possesses several drawbacks. First, the needle-and-seat valve disposed in the inlet of the carburetor's float bowl is not designed to accommodate double the amount of pressure/flow. For example, most carburetor needle-and-seat valves are designed for 8 psig; however, the larger fuel pump increases fuel line pressure to roughly 16 psig. Consequently, the higher pressure forces the needle-and-seat valve to remain open constantly, and fuel is continuously fed to the float bowl regardless of the fuel level. As a result, fuel bleeds out of the float bowl, and ends up, among other places, in the oil pan. This necessitates changing the oil between each use of the automobile. Moreover, because the needle-and-seat valve never closes, it is impossible to control the amount of fuel being forced through the float bowl, thereby wasting much fuel. Finally, the requisite larger fuel pump is generally an expensive piece of equipment, and may actually be cost-prohibitive in some cases.

A problem exists, therefore, in modifying an existing gasoline carburetor for use with a fuel having lower volatility such as alcohol in a manner consistent with the ordinary use of the carburetor, and in a manner that is cost-effective.

SUMMARY OF THE INVENTION

The above and other problems are solved by the present invention. The invention includes a fuel bowl assembly that allows the carburetor to use different volatility fuels, such as gasoline or alcohol based fuels, without changing the standard operation of the carburetor. Moreover, gasoline carburetors of the type having metering blocks and fuel bowls, can be easily converted for use with alcohol by using a spacer in accordance with the invention. Once the spacer is integrated into the carburetor assembly, the assembly can still be used for gasoline.

In one embodiment of the invention, the fuel bowl assembly of the invention includes a spacer interposed between a conventional metering block and conventional fuel bowl. In another embodiment of the invention, the conventional fuel bowl is not used, and a pair of spacers are mounted in series on the metering block and the open end of the outermost spacer is closed by an end plate. However, in either embodiment, the fuel bowl assembly includes, at least, a pair of inlets, a pair of floats and an interior fuel chamber, which is approximately twice the size of the conventional fuel bowl interior fuel chamber.

In an embodiment of the invention, the housing of the spacer may include a baffle for controlling fuel turbulence in the interior fuel chamber. Slots may be provided in the baffle to facilitate equalization of the fuel in the interior fuel chamber.

In one embodiment, the inventive attachment includes a substantially annular body having an interior volume; the body has a cross-sectional profile conforming to a cross-sectional profile of the float bowl of the carburetor. A fuel passage through the body having an inlet end coupleable to the fuel supply and a discharge end communicating with the interior volume is provided. A valve is disposed in the fuel passage to close the fuel passage selectively. The attachment also includes a float, disposed in the interior volume, operatively coupled to the valve, and mounted to the body for movement between a first, closed position in which the float closes the valve and a second, open position in which the valve is permitted to open the fuel passage. The attachment is sealingly disposed between the float bowl and the metering block and is in fluid communication with the float bowl and the metering block.

The attachment also includes an injecting means for injecting a spurt of fuel directly into the carburetor under predetermined conditions, particularly when the throttle is initially opened and the air-fuel ratio would otherwise be lean. The injecting means is disposed for operative engagement by the throttle linkage. The injecting means typically includes an accelerator pump of conventional design.

In the above description, the invention includes an attachment or spacer that fits between the float bowl and the metering block. However, in alternate design, a replacement float bowl may be provided. The inventive float bowl includes a body having a peripheral wall, an open end, an opposite, closed end, and an interior volume bounded by the peripheral wall and the open and closed ends. First and second fuel passages are provided through the body. Each of the first and second fuel passages has an inlet end coupleable to the fuel supply and a discharge end communicating with the interior volume. First and second valves are disposed respectively in the first and second fuel passages to close the fuel passages selectively. First and second floats are disposed in the interior volume, respectively operatively coupled to the first and second valves, each of the floats being mounted to the body for movement between a first, closed position in which the float closes the respective valve and a second, open position in which the respective valve is permitted to open the respective fuel passage. As above, the float bowl is preferably provided with an injecting means as described.

In operation, in either design, fuel is pumped into the two (or more) fuel passages from the fuel pump in parallel Both inlets possess floats, which govern the position of their respective valves, typically needle-and seat valves. When the fuel level in the float bowl/attachment drops to a certain level, the floats drop accordingly, and the needle-and-seat valves open, allowing fuel to enter the float bowl/attachment. The vacuum of the venturi then pulls fuel from the float bowl/attachment in a conventional fashion.

By use of the present invention, either in the form of an attachment disposed between the original float bowl and metering block or in the form of a replacement float bowl having multiple floats and valves, twice as much fuel (or more) is allowed to enter the system via the two (or more) fuel passages. A more powerful fuel pump is therefore not required. By avoiding using a more powerful fuel pump, the needle-and-seat valves function in the manner in which they were intended: i.e., they allow fuel to enter when it is needed, but to restrict fuel flow when the fuel level is adequate. Thus, fuel flow can be properly controlled, fuel is not wasted, and the oil pan is not contaminated with spill-over fuel. Moreover, the expense of using a larger fuel pump can be avoided.

BRIEF DESCRIPTION OF THE DRAWINGS

Referring now to the drawings which form a part of this disclosure.

DESCRIPTION OF THE PREFERRED EMBODIMENTS

Figure 1:
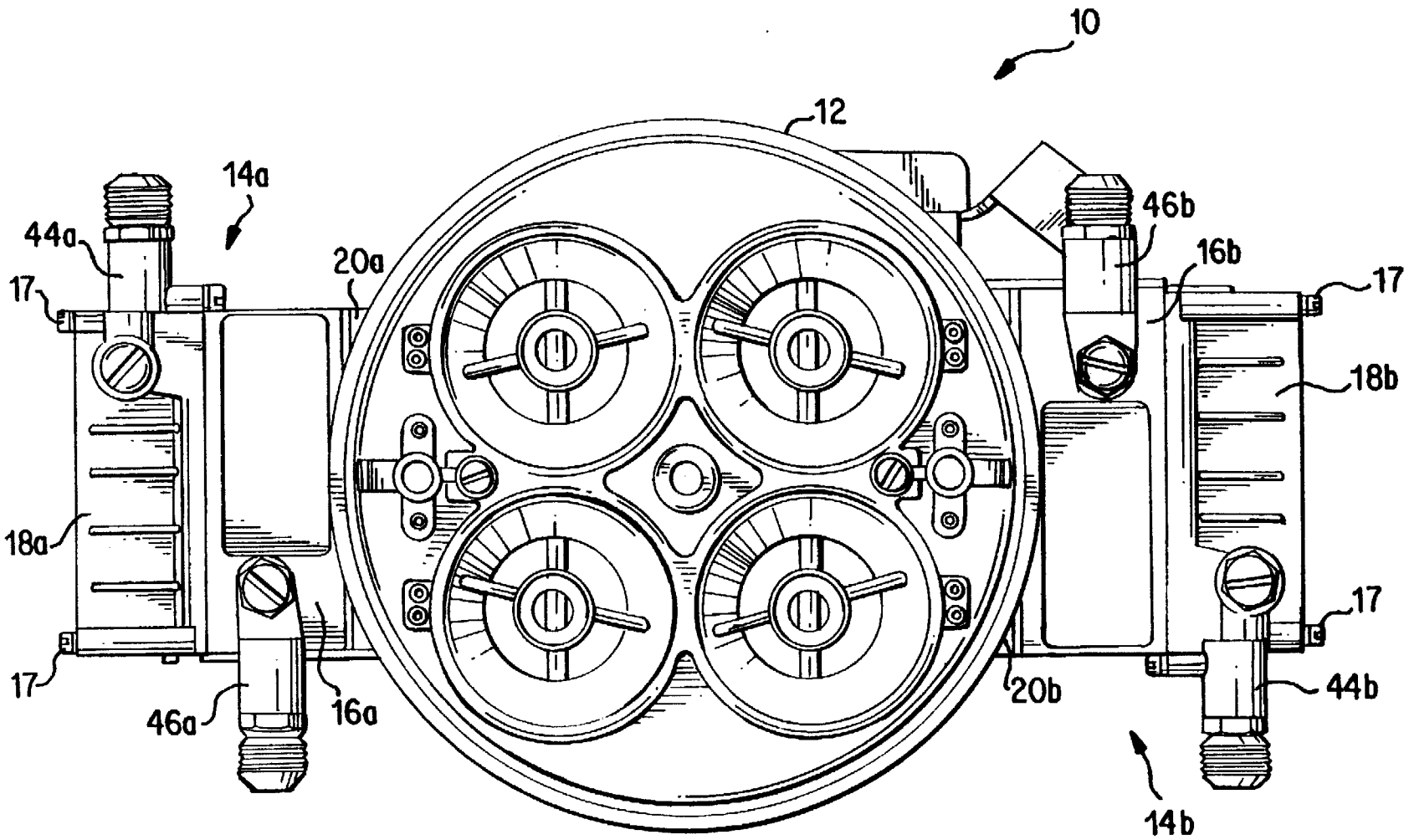
FIG. 1 is a top view of a carburetor including spacers in accordance with an embodiment of the invention.

A description of the invention will now be provided with reference to the accompanying drawings. Throughout the drawings, like parts are represented by like reference numerals.

The invention relates to a carburetor assembly as shown generally by reference numeral 10 in FIG. 1. Carburetor assembly 10 includes, generally, a carburetor main body 12 in fluid communication, via metering blocks 20*a* and 20*b*, with a pair of fuel bowl assemblies 14*a* and 14*b* disposed, one each, on opposing sides of carburetor main body 12. Carburetor main body 12 draws fuel from fuel bowl assemblies 14*a* and 14*b* at different rates depending upon the volatility of fuel that is being used. For example, a carburetor draws alcohol based fuels, such as methanol, at over two times the rate that gasoline is drawn.

Figure 7:
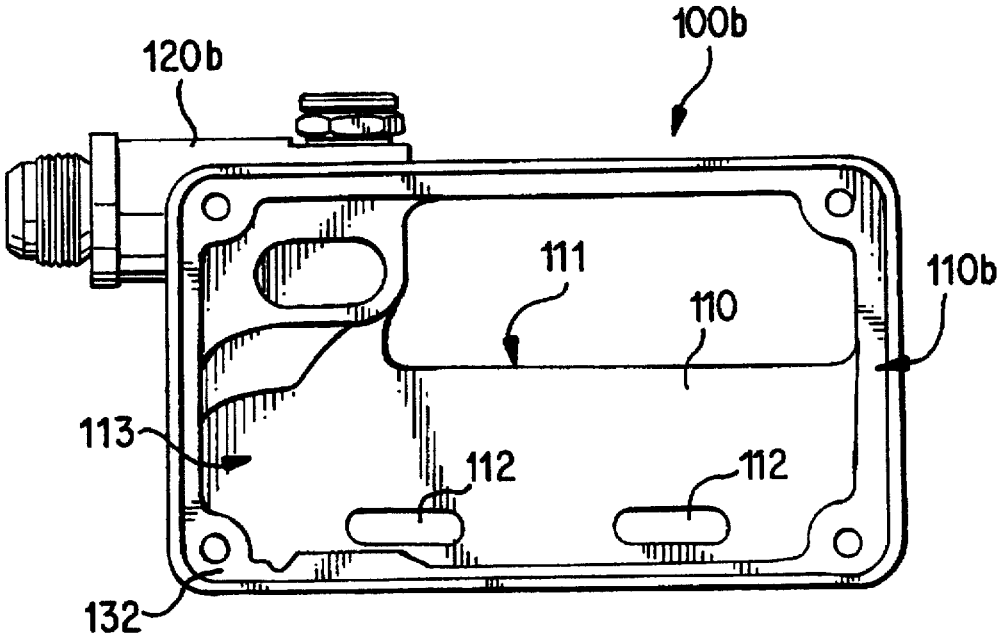
FIG. 7 is a view the opposing side of the spacer housing of the spacer shown in FIG. 6.

By using fuel bowl assemblies 14*a* and 14*b* in accordance with the invention, carburetor assembly 10 can accommodate different types of fuel having different volatility, such as gasoline and alcohol, without altering the basic operation of carburetor assembly 10. In particular, carburetor assembly 10 can operate at its normal fuel pressure levels (e.g., 8 psig.) Fuel bowl assemblies 14*a* and 14*b* include a pair spacers 16*a* and 16*b* used in combination with: a pair of conventional float bowls 18*a* and 18*b* as shown in FIG. 1; or, in the alternative, with a second pair of spacers 100*a* and 100*b* and pair of end plates 102*a* and 102*b*, as shown in FIG. 7. Fuel bowls 14*a* and 14*b* have fuel inlets 46*a*, 46*b*, 44*a*, and 44*b* as will be discussed in detail later.

In accordance with the embodiment shown in FIG. 1, carburetor assembly 10 includes the following main components, carburetor main body 12, metering plates 20*a* and 20*b*, spacers 16*a* and 16*b*, and float bowls 18*a* and 18*b*. The components of the carburetor assembly 10 are secured, respectively, on each side of carburetor main body 12 by threaded mounting rods 17, which pass through correspondingly threaded mounting holes in carburetor main body 12, metering blocks 20*a* and 20*b*, spacers 16*a* and 16*b*, and float bowls 18*a* and 18*b*. Disposed between adjacent components of carburetor assembly 10 is a conventional gasket (not shown) of resilient material such as rubber. The gaskets form a liquid tight seal between adjacent components of carburetor assembly 10.

Figure 2:
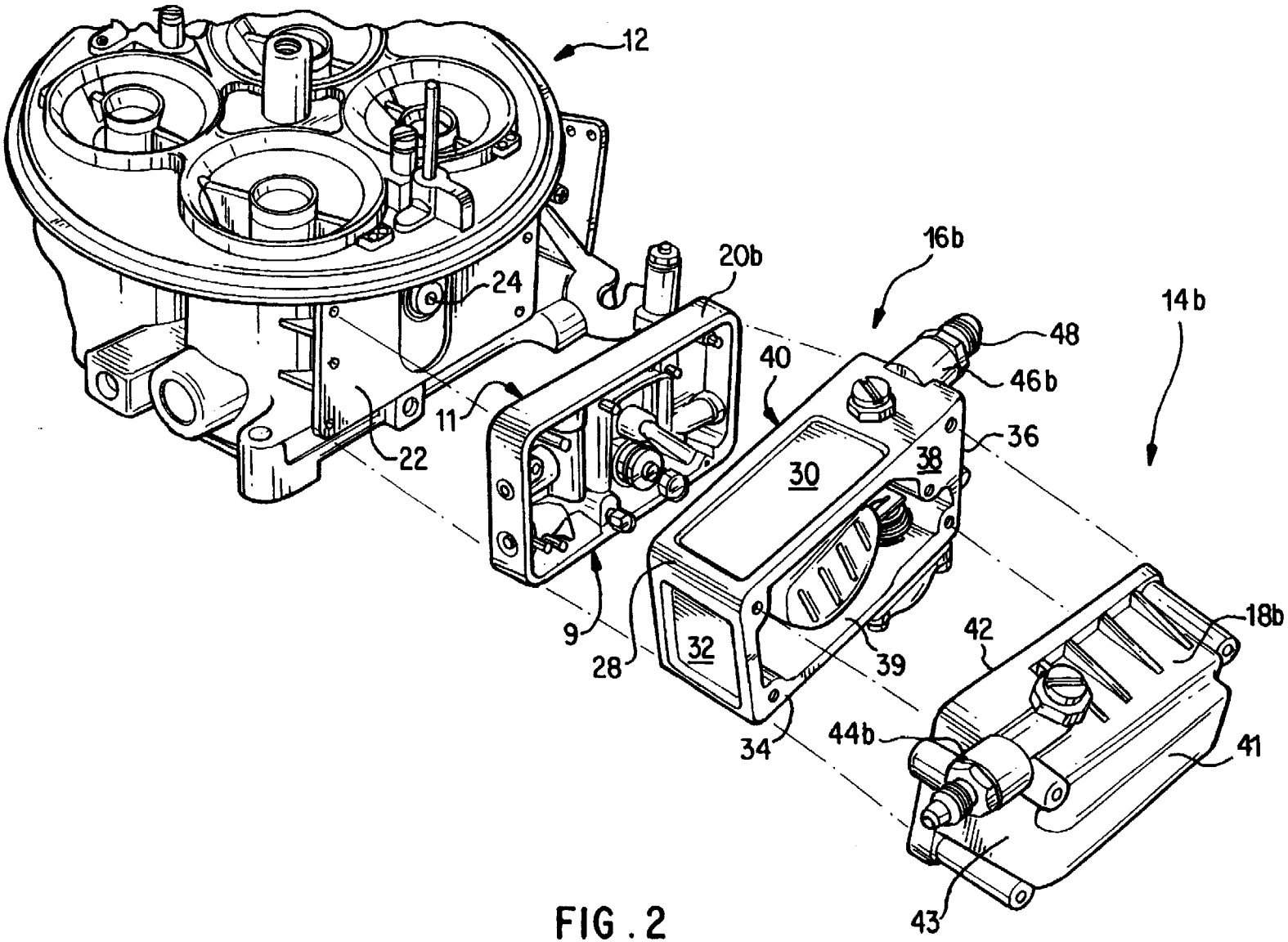
FIG. 2 is an exploded perspective view of one side of the carburetor shown in FIG. 1.

Referring now to FIG. 2, a discussion of one-half of carburetor assembly 10 will now be provided. For purposes of this embodiment of the invention, each half of carburetor assembly 10 is substantially a mirror image of the other. Thus, the following describes only one-half of carburetor assembly 10 with the understanding that this discussion is equally applicable to the other side of carburetor assembly 10. Also, it should be noted that the invention is not limited to dual fuel bowl assemblies 14*a* and 14*b*, but is equally appropriate for use in a single fuel bowl assembly.

Carburetor main body 12 is of a generally conventional construction and operates in accordance with conventional practice to mix fuel vapor and air before combustion. Carburetor main body 12 is shown as a four barrel carburetor, but may be a two barrel carburetor. As discussed above, with the invention the basic operation of carburetor assembly 10 is unchanged. However, when using alcohol, an alcohol type carburetor main body must be used rather than a gasoline type carburetor. The only difference between these types of carburetor main bodies is that in the alcohol carburetor main body the fuel passages (not shown) are 2.3–2.5 times larger in diameter than the fuel passages in the gasoline carburetor main body. This is to accommodate the greater required flow rate of alcohol over the flow rate of gasoline.

Carburetor main body 12 includes a housing 28 with a mounting surface 22 formed on an exterior side of housing 28. Mounting surface 22 is a substantially planar rectangular shaped surface with a central opening for providing access to a fuel vapor inlet 24.

Metering block **20*b* is of a conventional construction and controls the passage of fuel from the fuel bowl assembly 14*b* into carburetor main body 12 in accordance with conventional practice to form fuel vapor for carburetor main body 12. Metering block 20*b* mixes air with the fuel from the interior fuel chamber of fuel bowl assembly 14*b* in accordance with conventional practice. Metering block has two opposing sides 9 and 11. Side 11 of metering block 20*b* is disposed on mounting surface 22. Fuel vapor produced by metering block 20*b* is supplied to carburetor main body 12 in accordance with conventional practice, for example, via inlet 24. Fuel bowl assembly 14*b* is mounted on side 9 of metering block 20*b***.

Fuel bowl assembly **14*b* stores fuel in its interior fuel chamber and replenishes the fuel as needed by way of fuel inlets 46*b* and 44*b*. The control of fuel through inlets 46*b* and 44*b* will be discussed below. Carburetor main body 12 draws fuel, via metering block 20*b*, from fuel bowl assembly 14*b*. In the present invention, fuel bowl assembly 14*b* defines the interior fuel chamber. The interior fuel chamber includes a first portion defined by spacer 16*b*, which is substantially the same size as a second portion of the interior fuel chamber. The second portion is defined by conventional float bowl 18*b*. Accordingly, the use of spacer 16*b* approximately doubles the size of the interior fuel chamber, as compared to when conventional float bowl 18*b* is used alone. Conventionally, the float bowl 18*b* would have been attached directly to metering block 20*b***.

Spacer **16*b* is interposed between side 9 of metering block 20*b* and float bowl 18*b*. Float bowl 18*b* is of a conventional type having a fuel inlet 44*b* with one end in fluid communication with a conventional fuel pump (not shown) and another end in fluid communication with the interior fuel chamber. Float bowl 18*b* has a housing that has an annular four sided wall 43, a closed end 41 and an open end 42. Again, in the present invention, the housing of float bowl 18*b* defines the second portion of the interior fuel chamber, which is about one half of the interior fuel chamber. The flow of fuel from the fuel pump through fuel inlet 44*b* and into float bowl 18*b* is controlled by a conventional check valve regulated by a float (not shown) inside float bowl 18*b*. The buoyancy of the float allows the float to float partially submersed in the fuel in the interior fuel chamber. The float rises and falls along with the level of the fuel, thereby controlling the passage of fuel through fuel inlet 44*b* into the interior fuel chamber. The fuel level in the interior chamber must be maintained at a particular level for proper performance. The fuel level in the interior fuel chamber should be level with the opening of the main discharge nozzle (not shown) of carburetor main body 12**. The fuel, generally, fills approximately three-quarters of the interior fuel chamber. A slight drop in the fuel level is adequate to cause the float to allow the entry of the fuel into the interior fuel chamber.

Spacer **16*b* has a housing 28 that is substantially a rectangular box-shaped configuration and defines the second portion of the interior fuel chamber. Spacer 16*b* is shaped to correspond to the conventional substantially rectangular shaped metering plate 20*b* and float bowl 18*b*. Accordingly, any shape corresponding to the shape of metering block 20*b* and/or float bowl 18*b* can be used. Spacer 16*b*** is preferably made from machined metal and more preferably from anodized aluminum. However, any type of material that can be used so long as the material is capable of use in an environment with automotive fuel such as gasoline, kerosene, alcohol or the like.

Housing 28 is essentially six sided. An annular four sided wall has solid walls 30, 32, 34 and 36. Walls 30 and 34 are disposed parallel to each other and substantially perpendicular to walls 32 and 36, while walls 32 and 36 are disposed parallel to each other and substantially perpendicular to walls 30 and 34. Two opposing major sides 38 and 40 include openings 39 and 41 (shown in FIG. 3). Sides 38 and 40 are disposed substantially parallel to each other and substantially perpendicular to wall sections 30, 32, 34 and 36. Side 40 of spacer **16*b* is disposed adjacent metering block 20*b* and side 38 of spacer 16*b* is disposed adjacent open end 42 of float bowl 18*b***.

Fuel inlet **44*b* is positioned on an opposite side of fuel bowl assembly 14*b* than fuel inlet 46*b*. This arrangement is preferred because it is believed to reduce turbulence in the interior fuel chamber. However, fuel inlet 44*b* may be positioned on same side as fuel inlet 46*b*; varying the disposition of the fuel inlets 44*b* and 46*b*** is within the scope of the invention.

Figure 3:
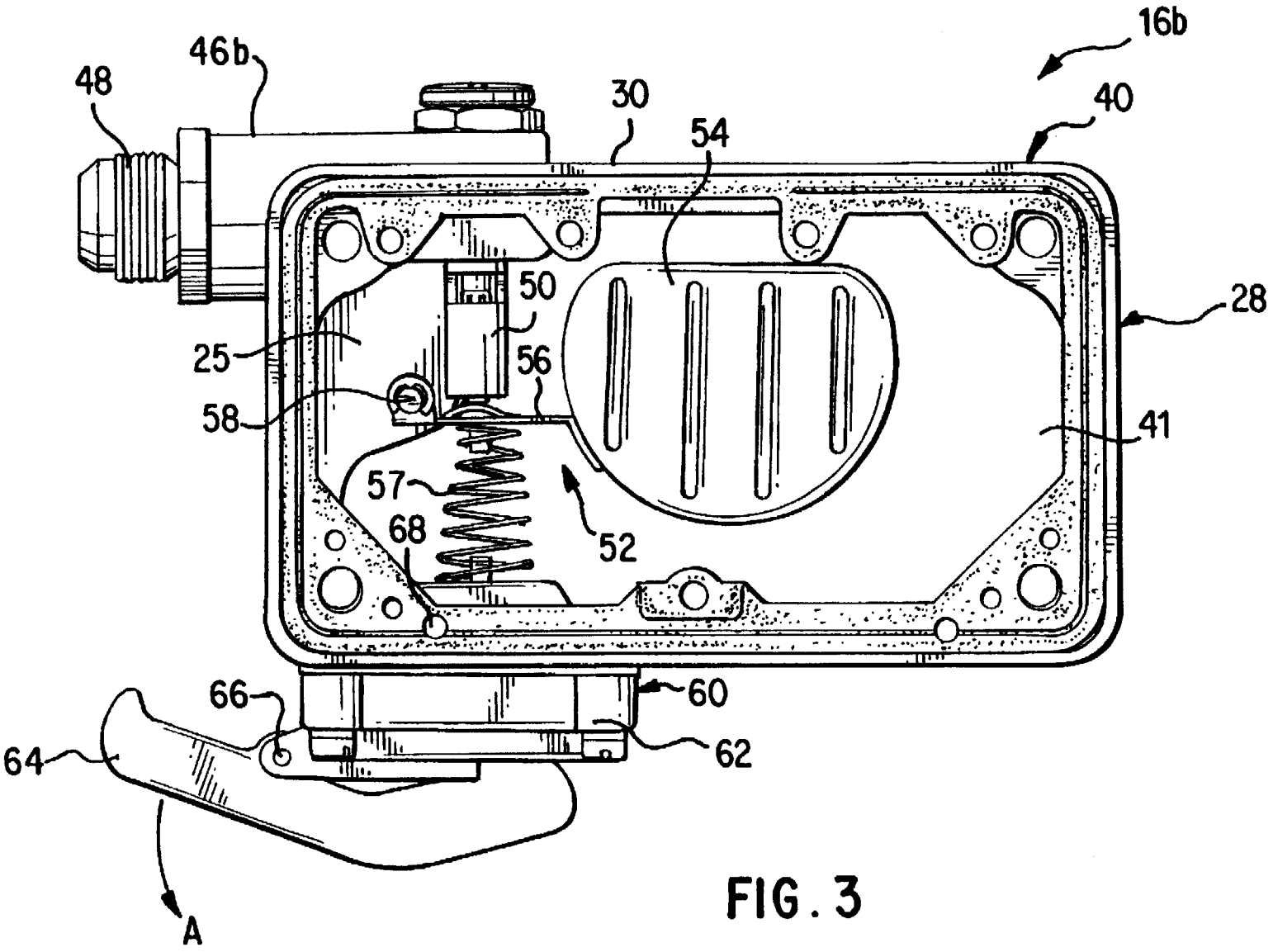
FIG. 3 is a side view of the spacer in accordance with an embodiment of the invention.

Referring now to FIG. 3, the components of spacer **16*b* will be discussed. In FIG. 3, spacer 16*b* is viewed from side 40. Spacer 16*b* is shown with an annular thin gasket 41, of the type discussed earlier, positioned on side 40 and having a substantial open central portion. As shown, side 40 includes a slight annular recess having a depth substantially equal to the thickness of gasket 41 for purposes of receiving and positioning gasket 41 on side 40. Spacer 16*b* includes fuel inlet 46*b* to supply fuel to the interior fuel chamber. By including fuel inlet 46*b* in addition to fuel inlet 44*b*, fuel can be supplied to the interior fuel chamber at an increased rate. This will insure that enough fuel can be provided to accommodate increased fuel demands when an alcohol based fuel is used. Fuel inlet 46*b* has a first end disposed outside housing 28 of spacer 16*b*, including a nozzle 48 for connecting fuel inlet 46*b* with a conventional fuel pump (not shown) via a conventional fuel line (not shown). Fuel inlet 46*b* has a second end opening into the first portion of the interior fuel chamber inside housing 28 of spacer 16*b*. A valve 50 is disposed at the second end opening of fuel inlet 46*b* inside housing 28 to regulate the flow of fuel through fuel inlet 46*b* into the interior fuel chamber. The operation of valve 50 is controlled by float assembly 52. Float assembly 52 is disposed inside spacer 16*a* to monitor the fuel level in the interior fuel chamber. Valve 50 and float assembly 52 are provided in addition to and operate along with the valve and float in float bowl 18*b***.

Even though spacer **16*b* is added, the same predetermined fuel level is maintained in the interior chamber. That is, the fuel level should remain level with the opening of the main discharge nozzle of carburetor main body 12, as in the conventional fuel bowl 18*b*. However, because the interior fuel chamber has an increased volume, the amount of fuel that can be stored in the interior chamber is increased. Float assembly 52, in cooperation with the float in float bowl 18*b*, enables the accurate and precise control of the fuel level in this enlarged volume of the interior fuel chamber. If only the conventional float in float bowl 18*b* were to control the fuel level across this enlarged interior fuel chamber, performance will likely be sacrificed. Accurate control of the fuel level is necessary to insure peak performance. If the fuel level in the interior fuel chamber is too low, not enough fuel will be supplied to carburetor main body 12 and the engine will stall when the vehicle makes turns. If the fuel level in the interior fuel chamber is too high, too much fuel will be supplied to carburetor main body 12. By utilizing spacer 16***a* in accordance with the invention, the amount of fuel that can be stored in the interior fuel chamber is essentially doubled without compromising performance.

Accordingly, float assembly 52 is provided in spacer 16*a*, in addition to the float assembly provided in float bowl 18*b*, to assure that a precise and accurate fuel level is maintained in the interior fuel chamber. Valve 50, as shown, is a conventional needle and seat valve. Float assembly 52 includes a float 54 connected to a float lever 56. A portion of valve 50 contacts float lever 56 so as to be correspondingly controlled thereby. Float lever 56 has an end rotatably mounted on pin 58, which is disposed on an interior surface of side 38 such that float 54 may rise and fall along with the level of fuel in the interior of the fuel chamber. As float 54 rises and falls, float lever 56, in turn, controls the needle and seat valve 50, which, in turn, opens and closes fuel inlet 46*b*, thereby controlling the flow of fuel from the fuel pump into the interior fuel chamber. In the present invention, float assembly 52 is constructed to have a same buoyancy as the buoyancy of the conventional float in float bowl 18*b* so that float 54 in spacer 16*b* rises and falls at the same rate and at the same level as the float in float bowl 18*b*. Float lever 56 is free to rotate around pin 58, however, a biasing spring 57, as shown, may be provided on the bottom portion of float lever 56.

Spacer 16*b* may be provided with a conventional accelerator pump 60, such that fuel can be squirted into carburetor main body 12 via metering block 20*b* whenever desirable. As shown, accelerator pump 60 is disposed in a housing 62 on side 34 of spacer 16*b*. Accelerator pump 60 is in fluid communication with the interior fuel chamber via small bores (not shown); and metering block 20*b* via channel 68. Cam arm 64, which pivots on pin 66 is cammingly engaged with a throttle (not shown). When the throttle is initially pressed, cam arm 64 is moved in the direction of arrow A around pin 66, thereby forcing fuel that has accumulated in accelerator pump 60 to be squirted into metering block 20*b* via channel 60. Although accelerator pump 60 is shown disposed on spacer 16*b*, it is within the scope of invention, as an alternative, to dispose accelerator pump 60 on float bowl 18*b*.

Figure 4:
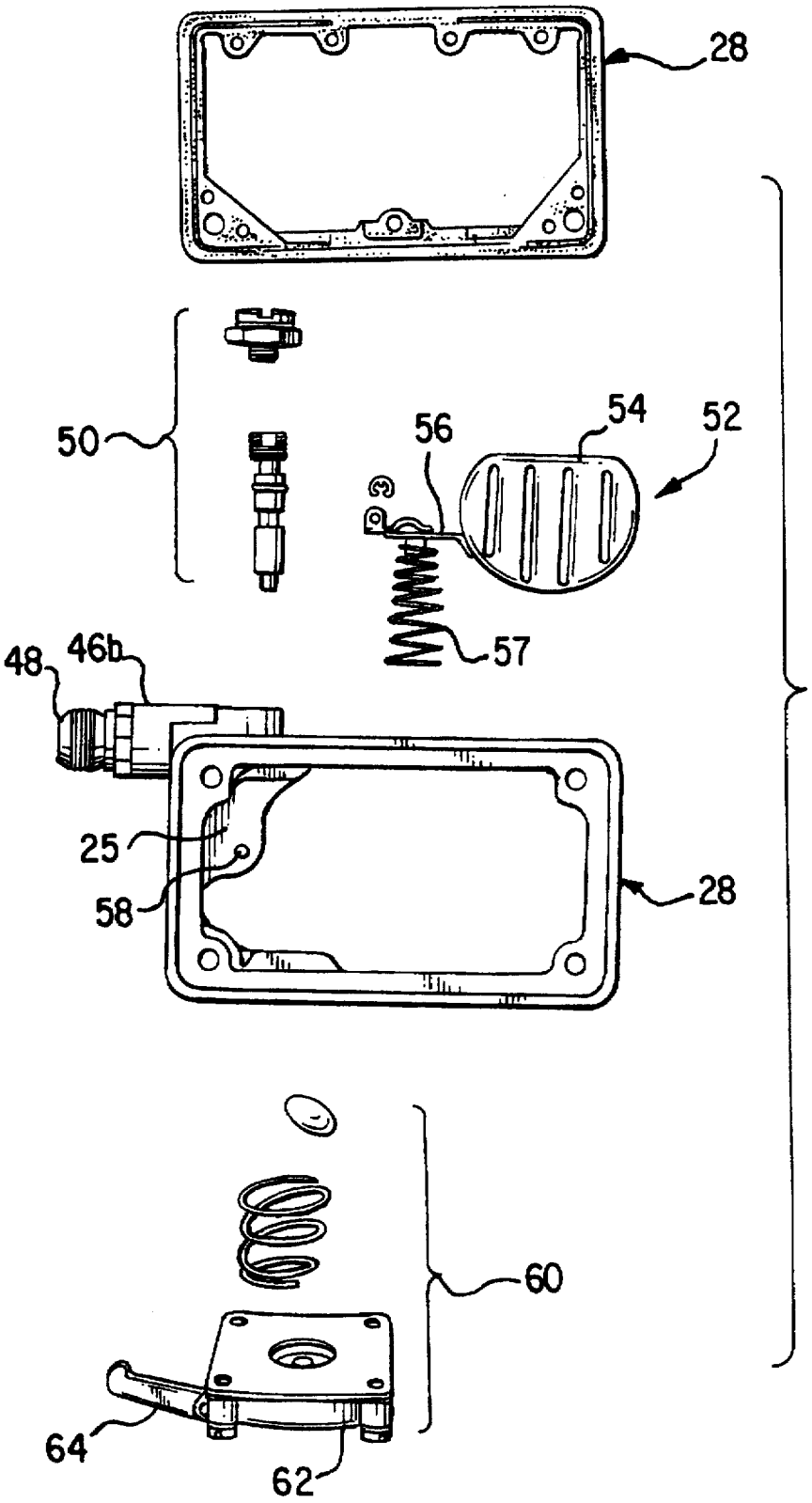
FIG. 4 is an exploded view of the components of the spacer shown in FIG. 3.

An exploded view of the components of spacer 16*b* discussed above is provided in FIG. 4. The components of spacer 16*b* can be made from any of the conventional materials used in the components of float bowl 18*b*.

Figure 5:
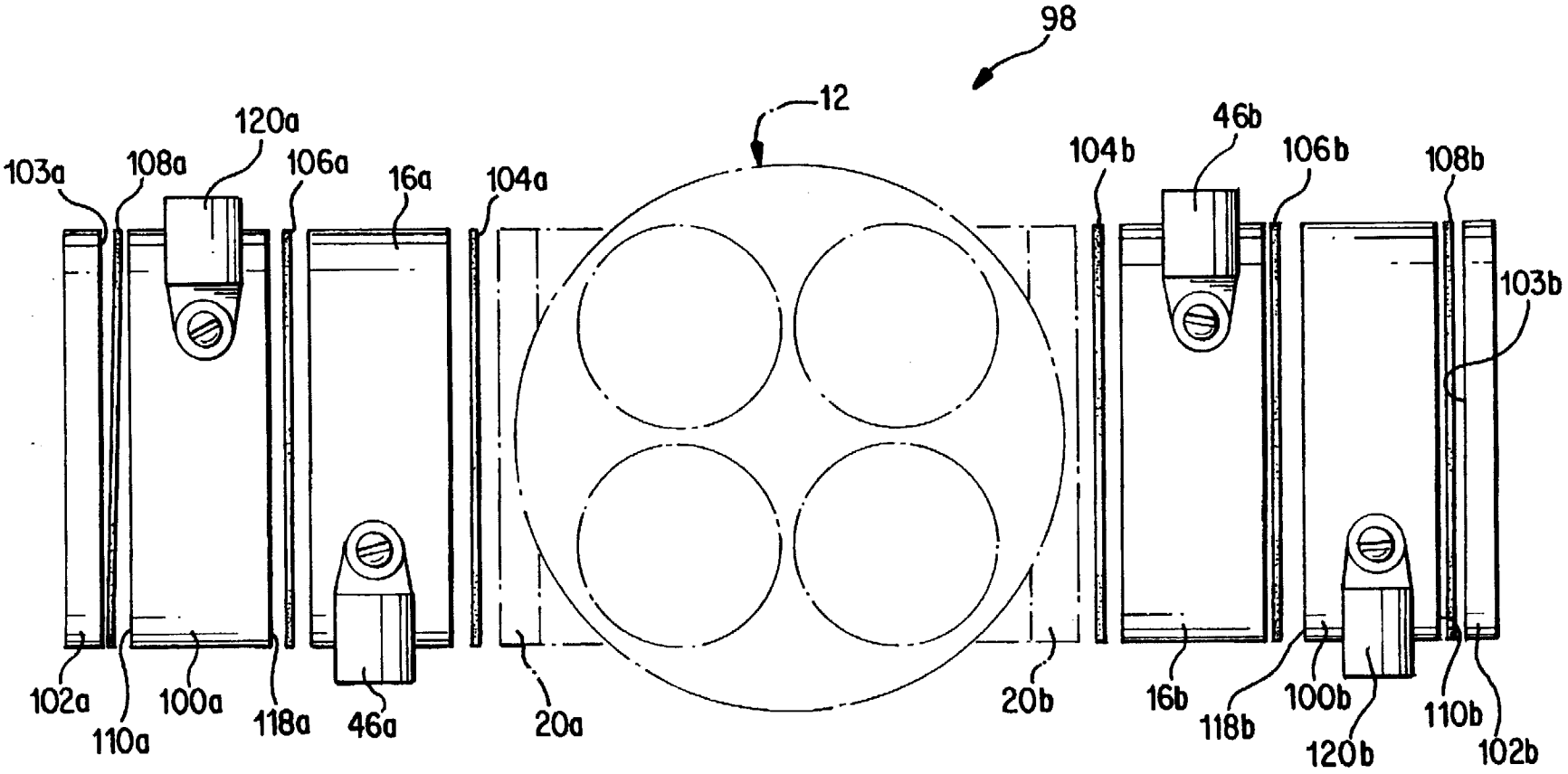
FIG. 5 is a high level top view of a carburetor in accordance with another embodiment of the invention.

Referring now to FIG. 5, a carburetor assembly in accordance with an alternate embodiment of the invention is shown generally at reference numeral 98. Carburetor assembly 98 is similar to carburetor assembly 10 discussed above, however, float bowls 18*a* and 18*b* have been replaced by spacers 100*a* and 100*b* and end plates 102*a* and 102*b*.

Spacers 100*a* and 100*b* include fuel inlets 120*a* and 120*b* to supply fuel to the interior fuel chambers, respectively. Spacers 100*a* and 100*b* are substantially the same as spacers 16*a* and 16*b* as discussed above, thus explanation will not be provided again. However, spacers 100*a* and 100*b* may include a housing 130 configured differently from housing 28 as discussed below. Nonetheless, spaces 100*a* and 100*b* include opposing sides 118*a*, and 118*b*; and 110*a* and 110*b*, respectively, each of which has an opening. Accordingly, end plates 102*a* and 102*b* are provided to close the openings in sides 110*a* and 110*b*, respectively. Ends plates 102*a* and 102*b* may have a recess formed on sides 103*a* and 103*b* to enlarge the interior fuel chamber slightly. For purposes of illustration, gaskets 104*a*, 104*b*, 106*a*, 106*b*, 108*a*, and 108*b* are shown positioned between the components of carburetor assembly 98 as mention in the embodiment shown in FIG. 1.

As shown, carburetor assembly 98 includes fuel inlets 46*a*, 46*b*, 120*a* and 120*b*. On the left side of carburetor main body 12, fuel inlets 120*a* and 46*a* are disposed on opposite sides; and on the right side of carburetor main body 12 fuel inlets 46*b* and 120*b* are shown opposing each other. However, the disposition of fuel inlets 46*a*, 46*b*, 120*a* and 120*b* may be varied in accordance with the invention.

Figure 6:
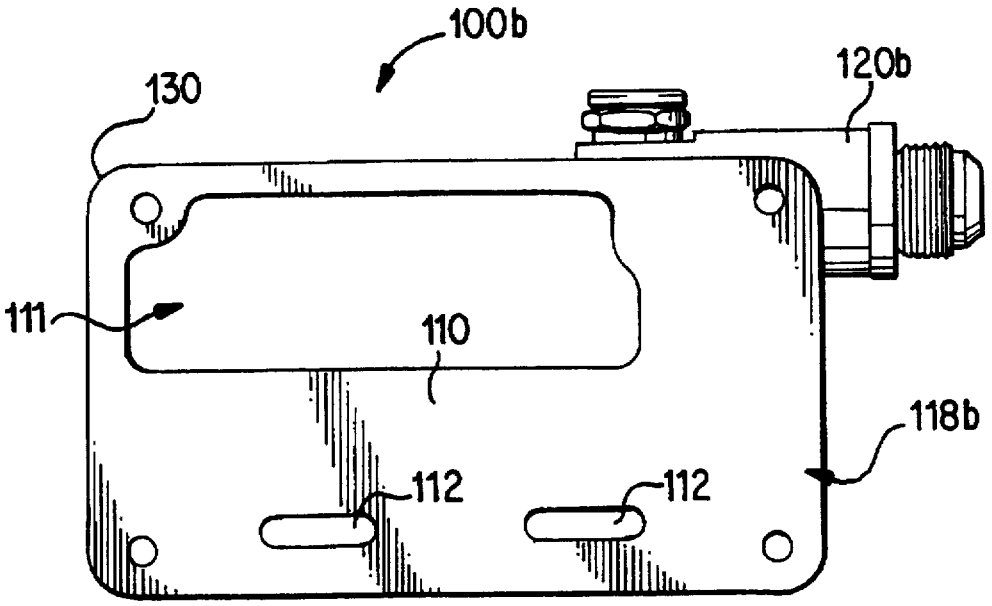
FIG. 6 is a side view of a spacer housing in accordance with another embodiment of the invention.

Spacers 100*a* and 100*b* may include housing 28 of spacers 16*a* and 16*b* discussed above, or in the alternative, spacers 100*a* and 100*b* may comprise the alternate housing configuration, housing 130, as shown in FIGS. 6 and 7. Similarly, if desirable, spacers 16*a* and 16*b* may include housing 130. Thus, spacers 16*a*, 16*b*, 100*a* and 100*b* may include any combination of housings 28 and 130.

In housing 130, sides 118*a* and 118*b* of spacers 110*a* and 110*b* include a side 132 with opening 113 as shown in FIG. 7. Open side 132 is substantially the same as open side 40 of housing 28. In the embodiment shown in FIG. 5, sides 110*a* and 110*b* of spacers 100*a* and 100*b* preferably have include side 132. As shown in FIG. 6, side 130 includes a baffle 110 defining an opening 111, which is smaller than opening 39 in side 38 of housing 28. In the embodiment shown in FIG. 5, sides 118*a* and 118*b* would preferably have side 130. Baffle 110 serves to control turbulence and fluid flow in the interior fuel chamber. Preferably, baffle 110 is substantially centrally disposed to most effectively control fuel turbulence in the interior fuel chamber. Baffle 110 may include slots 112 passing through baffle 110 and disposed in close proximity to a bottom wall 115 of housing 130. Slots 112, as shown, are oval shaped. Slots 112 are provided to allow the fuel in the two portions of the interior fuel chamber to equalize. Moreover, if the fuel falls below the height of baffle 110, slots 112 will still allow the fuel level to equalize across the entire interior fuel chamber.

In the one embodiment (FIG. 1), the spacers may be retrofitted into a conventional gasoline carburetor assembly by mounting spacers, one each, between the metering blocks and float bowls. Then, the modified carburetor assembly can be used with either gasoline or alcohol. Again, as discussed above, the only modification to the structure is with the main carburetor body. The main carburetor body must have either gasoline fuel passages or alcohol fuel passages. Thus, when converting a gasoline carburetor assembly to alcohol, the fuel passages in the carburetor main body must be enlarged. In the other embodiment, the conventional fuel bowls may be entirely removed and replaced with fuel assemblies 14*a* and 14*b*, which are then mounted on the metering plates. It is within the scope of the invention to either have the spacers retrofitted or originally manufactured in the carburetor assembly in accordance with the invention.

Carburetor assembly 10 operates in the following manner. A vacuum produced in the venturi of carburetor main body 12 pulls fuel out of fuel bowl assemblies 14*a* and 14*b*. Thus, the fuel level drops in the interior fuel chamber of fuel bowl assemblies 14*a* and 14*b*. This drop in fuel level causes both floats in the interior chamber to drop along with the fuel level. Each float preferably drops at substantially the same rate and at substantially the same level as the other float. When the floats drop, the float levers and the needles in needle-and-seat valves also drop causing the valves to open allowing fuel from the fuel pump to enter the interior fuel chamber via the two fuel inlets. The addition of fuel into the interior fuel chamber causes the fuel level in the interior fuel chamber to rise, thereby raising the level of the floats and closing the needle-and-seat valves when the fuel returns to the desired level.

In accordance with the present invention, an additional flow path for fuel is added into the interior fuel chamber, additional interior volume in the fuel bowl assembly is provided, and an additional float assembly is provided in the interior fuel chamber, thereby increasing the amount of fuel that can be delivered to the carburetor as needed, without changing the fuel level in the interior fuel chamber, without sacrificing the accurate and precise control of the fuel level in the interior chamber, and without changing the basic operation of the carburetor assembly. Unlike a previously known method, which requires a more powerful fuel pump to force fuel into the float bowl, the present invention operates at normal fuel pressure levels (e.g., 8 psig). Because the fuel is under normal pressure, the needle-and-seat valves close properly and reliably when the fuel inside the float bowl reaches the desired level. As a result, fuel does not bleed from the float bowl into the oil pan and elsewhere; fuel is not wasted, and the oil need only be changed according to a normal maintenance schedule. Moreover, an expensive fuel pump need not be added to the fuel system of the automobile; the original fuel pump is still used in the present invention.

The present invention is not limited in scope to what is described above. For example, the fuel assemblies of the invention can be used with alcohol, kerosene, or gasoline alone or in combination. The fuel assemblies, especially, spacers 16*a*, 16*b*, 100*a* or 100*b*, may include additional fuel inlets. Moreover, any quantity of spacers may be provided on the carburetor assembly to accomplish the teachings of the invention. The spacers need not be separately formed and may be contiguous housings so long as the portions of the interior fuel chamber remain in fluid communication.

While the invention has been particularly shown and described with reference to preferred embodiments thereof, it will be understood by those skilled in the art that various changes in form and details may be made therein without departing from the spirit and scope of the invention.

What is claimed is:

1. An attachment for a fuel system, the fuel system having a carburetor with a metering block having fuel passages therethrough and a float bowl, a fuel supply, and a throttle linkage, said attachment comprising:

an annular body having a metering block end, a float bowl end opposite said metering block end, and a peripheral wall, said peripheral wall and said ends defining therebetween an interior volume;

a fuel passage through said body and having an inlet end coupleable to the fuel supply and a discharge end communicating with said interior volume;

a valve disposed in said fuel passage to selectively close said fuel passage; and a float disposed in said interior volume, operatively coupled to said valve, and mounted to said body for movement between a closed position in which said float closes said valve and an open position in which said valve is permitted to open said fuel passage, said attachment being adapted for mounting between the metering block and the carburetor's float bowl with said metering block end of said body being configured for sealing engagement with the metering block, said float bowl end being configured for sealing engagement with the carburetor's float bowl, and said interior volume being configured to communicate with the carburetor's float bowl and the metering block's fuel passages.

2. The attachment of claim 1, further comprising an accelerator pump mounted to said body and disposed for operative engagement by the throttle linkage.

3. The attachment of claim 1, wherein said float bowl end is configured with an opening such that said interior volume is in fluid communication with the float bowl.

4. The attachment of claim 3, wherein said float bowl end includes a baffle bordering said opening, wherein said baffle has a height lower than a predetermined level at which fuel is to be maintained in said interior volume.

5. The attachment of claim 4, wherein said baffle includes a baffle opening.

6. The attachment of claim 5, wherein said baffle opening comprises comprises at least one slot.

7. The attachment of claim 1, wherein said annular body has a substantially rectangular box-shaped configuration.

8. The attachment of claim 1, further comprising an accelerator pump operatively disposed on said annular body.

9. The attachment of claim 1, the fuel system is an alcohol fuel system.

10. The attachment of claim 1, the fuel system is a gasoline fuel system.

11. A carburetor float bowl for use in a fuel system, said fuel system having a fuel supply, a throttle linkage, and a fuel carburetor with a metering block having fuel passages therethrough, said float bowl comprising:

a body having a peripheral wall, an open end, a closed end opposite said open end, and an interior volume bounded by said peripheral wall, and said open and closed ends;

first and second fuel passages through said body, each of said first and second fuel passages having an inlet end coupleable to the fuel supply and a discharge end communicating with said interior volume;

first and second valves, each respectively disposed in said first and second fuel passages to selectively close said respective fuel passages; and first and second floats, disposed in said interior volume, respectively operatively coupled to said first and second valves, each of said floats being mounted to said body for movement between a closed position in which said floats close said respective valves and an open position in which said respective valves are permitted to open said respective fuel passages, wherein said first and second valves are operated substantially identical such that said first valve is one of opened and closed in a first amount and said second valve is one of opened and closed in a second amount, which is the same as said first amount, said float bowl being adapted for mounting on the metering block with said open end of said body being configured for sealing engagement with the metering block, and said interior volume being configured to communicate with the metering block's fuel passages.

12. The float bowl of claim 11, further comprising an accelerator pump mounted to said body and disposed for operative engagement by the throttle linkage.

13. The float bowl of claim 11, wherein said discharge ends of said first and second fuel passages are disposed at opposite ends of said interior volume.

14. An attachment for a fuel system, the fuel system including a carburetor, a metering block capable of being coupled to the carburetor, and a fuel pump in fluid communication with the attachment, the attachment comprising:

a first housing defining a first fluid chamber and having a first end with a first opening and a second end with a second opening opposing said first end, said first housing including a first fluid inlet in fluid communication with the fuel pump and said first fluid chamber, wherein fuel flow through said first fluid inlet is controlled by a first regulator disposed in said first fluid chamber and said first end of said first housing is attached to the metering block;

a second housing defining a second fluid chamber and having a third end with a third opening and a fourth end with a fourth opening opposing said third end, said second housing including a second fluid inlet in fluid communication with the fuel pump and said second fluid chamber, wherein fuel flow through said second fluid inlet is controlled by a second regulator disposed in said second fluid chamber and said third end is attached to said second end of said first housing, whereby said first and second fuel chambers are in fluid communication; and a cover disposed on said fourth end of said second housing for closing said fourth end, wherein said first and second housings are capable of storing fuel in said first and second fuel chambers at a predetermined fuel level.

15. An attachment according to claim 14, wherein at least one of said second end of said first housing and said third end of said second housing includes a baffle portion bordering one of said first and second openings, wherein said baffle portion has a height lower than the fuel predetermined level at which fuel is to be maintained in said first and second chambers.

16. An attachment according to claim 14, further comprising a baffle formed on one of said first and second housings bordering one of said first and second openings, wherein said baffle has a base attached to one of said first and second housings and a distal end centrally disposed in at least one of said first and second fluid chambers.

17. An attachment according to claim 16, wherein said baffle includes at least one slotted opening, wherein fuel is capable of flowing through said slotted opening.

18. An attachment according to claim 14, further comprising a gasket disposed between said first housing and said second housing to form a liquid tight seal therebetween.

19. An attachment according to claim 18, further comprising a second gasket disposed between said second housing and said cover to form a liquid tight seal therebetween.

20. An attachment according to claim 14, further comprising a first side and a second side opposing said first side, wherein said first fluid inlet is disposed on said first side and said second fluid inlet is disposed on said second side.

21. A carburetor assembly, comprising:

a carburetor main body having a fuel vapor intake;

a fuel regulator connected to said carburetor main body and having a fuel vapor outlet and a fuel intake, wherein said fuel vapor outlet is in fluid communication with said fuel vapor intake of said carburetor main body;

a fuel supply assembly connected to said fuel regulator defining an interior fuel chamber for storing fuel at a fuel level, including, a first housing defining a first portion of said interior fuel chamber and having a first side with a first opening attached to said fuel regulator and a second side with a second opening, wherein said first housing includes a first fuel inlet passing through said housing and in fluid communication with said first portion of said interior fuel chamber, and a first regulator coupled to said first fuel inlet for controlling fuel flow through said first fuel inlet;

a second housing defining a second portion of said interior fuel chamber and having a third side with a third opening attached to said second side of said first housing and a fourth side with a fourth opening, wherein said second housing includes a second fuel inlet passing through said housing and in fluid communication with said second portion of said interior fuel chamber, and a second regulator coupled to said second fuel inlet for controlling fuel flow through said second fuel inlet; and an end plate disposed on said fourth side covering said fourth opening.

22. A carburetor assembly according to claim 21, wherein said fuel regulator comprises a metering block.

23. A carburetor assembly according to claim 21, wherein at least one of said second end of said first housing and said third end of said second housing includes a baffle portion bordering one of said first and second openings, wherein said baffle portion has a height lower than a predetermined level at which fuel is to be maintained in said first and second chambers.

24. A carburetor assembly according to claim 21, further comprising a baffle formed on one of said first and second housings bordering one of said first and second openings, said baffle extending inwardly and substantially parallel to one of said third and fourth ends, wherein said baffle has a base attached to one of said first and second housings and a distal end centrally disposed in at least one of said first and second fluid chambers.

25. A carburetor assembly according to claim 24, wherein said baffle includes at least one slotted opening, wherein fuel is capable of flowing through said slotted opening.

26. A carburetor assembly according to claim 21, wherein the carburetor operates with an alcohol fuel.

27. A carburetor assembly according to claim 21, wherein the carburetor operates with a gasoline fuel.

* * * * *